United States Patent [19]

Padden

[11] 4,300,037

[45] Nov. 10, 1981

[54] ELECTRONIC CONTROL SYSTEM FOR A RADIANT FURNACE

[75] Inventor: Harvey F. Padden, Wayne, N.J.

[73] Assignee: Oxy Dental Prod. Inc., Irvington, N.J.

[21] Appl. No.: 72,010

[22] Filed: Sep. 4, 1979

[51] Int. Cl.[3] ..... H05B 1/02

[52] U.S. Cl. ..... 219/497; 219/492; 219/498; 219/518

[58] Field of Search ..... 219/489, 490, 492, 494, 219/497, 493, 498, 502, 514, 518, 519, 241, 242, 251, 252, 413, 412; 236/46 F; 432/205, 184, 241, 250

[56] References Cited

U.S. PATENT DOCUMENTS

| | | | |
|---|---|---|---|
| 3,463,470 | 8/1969 | Green et al. | 432/241 |
| 3,517,160 | 6/1970 | Maga | 219/518 |
| 3,541,429 | 11/1970 | Martin | 219/492 |
| 3,794,808 | 2/1974 | Takagi | 219/497 |
| 3,855,452 | 12/1974 | Flaza et al. | 219/492 |
| 3,901,437 | 8/1975 | Harkins | 219/492 |
| 4,114,024 | 9/1978 | Donner | 219/489 |
| 4,134,005 | 1/1979 | Eppens | 219/492 |
| 4,139,341 | 2/1979 | Pfaffenbauer | 432/205 |
| 4,167,663 | 9/1979 | Granzow, Jr. | 219/497 |
| 4,184,067 | 1/1980 | Gress | 219/493 |

FOREIGN PATENT DOCUMENTS

| | | | |
|---|---|---|---|
| 2708552 | 8/1978 | Fed. Rep. of Germany | 219/497 |
| 456005 | 2/1975 | U.S.S.R. | 432/205 |

*Primary Examiner*—Gene Z. Rubinson
*Assistant Examiner*—Mark H. Paschall
*Attorney, Agent, or Firm*—Eugene Lieberstein

[57] ABSTRACT

A control system for operating a radiant furnace for curing ceramic products, the furnace having a furnace chamber, heating elements for applying radiant energy to the chamber, and movable platform means for supporting the ceramic product to be cured in the chamber. The control system generates a sensor signal responsive to the furnace temperature which is algebraically added to an idle temperature signal, a maximum temperature signal and a ramp signal. The algebraic sum produces an error signal which is applied to a polarity detector for controlling the heating elements in response to a predetermined polarity. The polarity detector is strobed when the sensor signal reaches the maximum temperature signal. Prior to reaching idle temperature the energy to the heating elements is applied in controlled graduated incremental levels. The idle temperature condition is a variable independent of the maximum temperature setting. The control system is fully automatic with the movable platform and ramp signal being responsive to the idle temperature condition. The ramp output is enabled upon reaching the idle temperature level and upon detection of the movable platform at its top position.

8 Claims, 6 Drawing Figures

ELECTRONIC CONTROL SYSTEM FOR A RADIANT FURNACE

This invention relates to an electronic control system for operating a radiant furnace of the type used for drying, firing and glazing ceramic materials.

Dental restorations and dentures are conventionally constructed from fused porcelain ceramics. Porcelain is formed by mixing and firing minerals, principally feldspar, kaolin and quartz to which may be added fluxes and pigments. The dental practitioner tailors the ceramic porcelain composition to the individual requirements for each restoration. The porcelain is then fired in a furnace. During the firing operation the porcelain undergoes several phases of physical change. Many of the desired physical properties and characteristics are established by controlling furnace conditions such as drying period, firing temperature, the rate at which the furnace temperature is permitted to increase during the firing cycle and the holding period at the firing temperature.

Some of the drawbacks in prior art radiant furnace controls relate to the inability to readily adjust and modify furnace operating conditions and to set up different combinations of curing conditions. In addition, prior art automatic control systems are restricted to operation with low fusing temperature heating elements. This limits the range of control over the firing cycle to a temperature range corresponding to the low temperature heating elements use in the furnace.

The control system of the present invention is designed to provide the dental practitioner maximum versatility in setting and adjusting furnace conditions. The operator may adjust the curing temperature cycle from an adjustable initial idle temperature for warming the ceramic to an adjustable maximum curing temperature over an adjustable rise time extending from zero to e.g., 120° F. per minute. It addition, the operator can maintain the temperature in the furnace chamber constant at the fusing or curing temperature over an adjustable period of time known as the "holding period". Other controls permit the operator to choose whether to fire the product in an atmosphere of either air or vacuum. When curing in a vacuum the temperature at which the vacuum is released known as the "breaking temperature" is also adjustable. The operator may also manually reset an operating cycle.

In addition to the foregoing controls the control system is operational with high fusing heating elements of, for example, platinum at temperature levels of up to 2500° F. or with conventional low fusing heating elements of, for example, a nickel alloy at a maximum temperature of about 2200° F. Accordingly, the control system of the present invention provides a wider latitude over temperature operation than heretofore possible. This is accomplished by the incorporation of an automatic pre-idle temperature cycle which stages the initial application of power to the heating elements in discrete energy levels until the idle temperature in the furnace is reached. The pre-idle temperature cycle causes a gradual warm up of the heating elements which minimizes wear. The pre-idle temperature cycle is also necessary if a platinum heating element is used, to compensate for severe resistance changes during warm up.

The control system of the present invention also permits adjustment over the initial air quench period following termination of the firing cycle when the product is first exposed to air.

Other advantages and features of the present invention will become apparent from the following detailed description of the invention when read in conjunction with the accompanying drawings in which.

Figure 1:
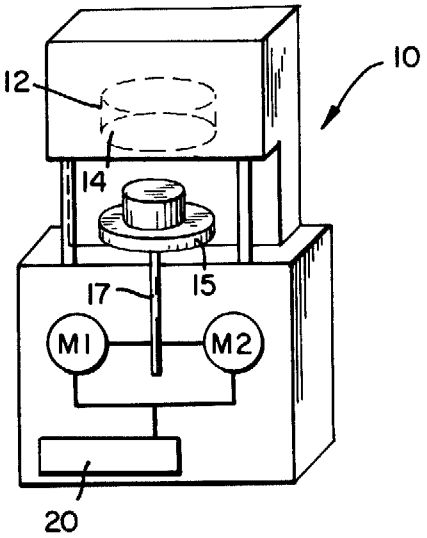
FIG. 1 is a simplified diagrammatic illustration of an automatically operated radiant furnace controlled by the furnace control system of the present invention.

Referring now to FIG. 1 in which a radiant furnace 10 is diagrammatically shown having a furnace chamber 12 with an opening 14 at the bottom end thereof for introducing a ceramic product 16. The ceramic product 16 is placed upon a movable support platform 15 which is automatically raised or lowered by a pair of motors M1 and M2 respectively. The movable platform 15 operates as a door to close and seal off the open end 14 of the furnace chamber 12 from the atmosphere when raised to its top position.

The motors M1 and M2 are coupled to a shaft 17, extending from the platform 15, through a gearing assembly (not shown) for either raising or lowering the platform 15 at a speed depending upon which motor is energized. Although two motors are used to provide positive control over the direction of travel of the platform 15 and preferably at different speeds, it is equally acceptable to use only one motor with a bidirectional governor. The motors M1 and M2 are driven under command from the control system 20 of the present invention. The type of motor control and the motor control logic does not form a part of the present invention.

Figure 2:
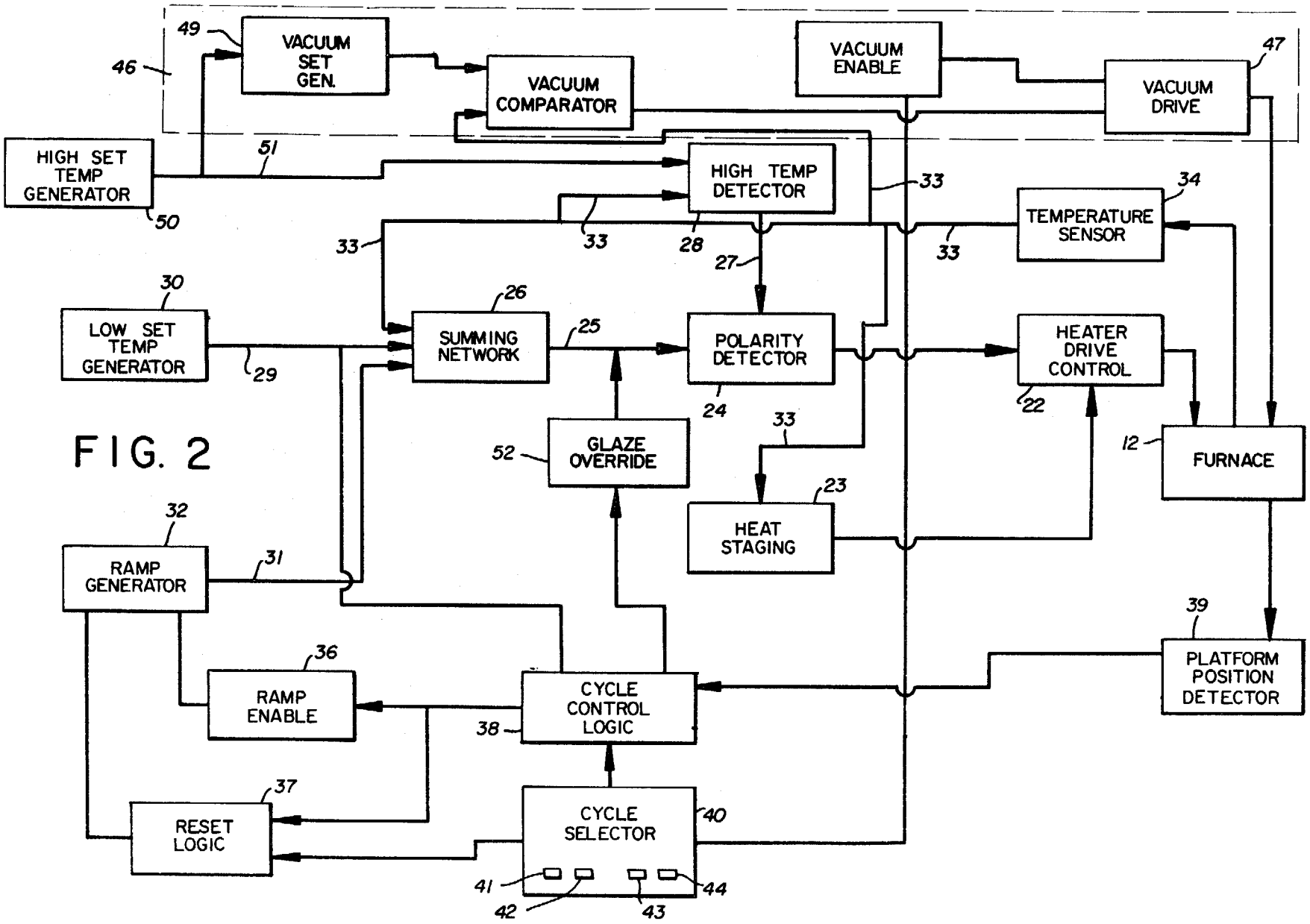
FIG. 2 is a block diagram of the furnace control system of the present invention.

The block diagram illustrating the control system 20 of the present invention is shown in FIG. 2. The temperature in the furnace 10 is controlled by a heater-drive control 22 which is selectively energized or deenergized in response to the output polarity of a polarity detector 24. The polarity detector 24 is in turn responsive to the output 25 of a summing network 26 and to the presence of a strobe signal 27 from a high temperature detector 28. The energy applied to the furnace during the initial pre-idle temperature period is controlled through the heater-drive control 22 from a heat staging circuit 23 as will be further elaborated upon hereafter.

The input signals applied to the summing network 26 include: the output 29 from a manually adjustable low set generator 30; the output 31 from a linear ramp generator 32 and the output 33 from a temperature sensor circuit 34. The low set generator 30 establishes the idle temperature level. The temperature sensor output 33 is representative of and proportional to the temperature in the furnace 10. The output 31 from the linear ramp generator 32 rises linearly at a predetermined rate from a predetermined minimum level, of, for example, zero volts starting at a point following the pre-idle temperature period and continuing until the ramp generator 32 is disabled by reset logic 37. The rise time or slope of the signal 31 is manually adjustable.

The ramp generator 32 is enabled by the enable circuit 36 under the direction and control of the cycle control logic circuit 38. The cycle control logic circuit 38 also directs the operation for raising or lowering the platform 15 through opertion of the fast or slow motor M1 or M2 respectively. A platform position detector circuit 39 detects when the platform 15 has reached the top position with the chamber 12 sealed and when the platform has descended to a predetermined bottom or at rest position.

The cycle control logic circuit 38 is responsive to the manual operating selections in the cycle selector 40. The cycle selector 40 includes a plurality of push button function switches 41, 42, 43, 44 and 45 respectively which are on the furnace front panel (not shown). The function switches 41, 42, 43, 44 and 45 identify the on/-off control, the regular and short glaze cycle controls, the vacuum enable control and the manual reset control respectively.

The temperature sensor circuit 34 includes a conventional temperature transducer such as a thermocouple 35 (shown in FIG. 4) which is located within the furnace chamber 12 to provide an emf signal output 33 proportional to the furnace temperature. The output 33 is applied as an input signal to the following circuits: the summing network 26 as indicated earlier; the heat staging circuit 23; the high temperature detector 28 and the vacuum comparator. The vacuum comparator is part of a vacuum control circuit 46 including a vacuum set generator 49, vacuum enable 48, and a vacuum drive 47.

The maximum firing temperarure level is manually established by adjustment of the high set temperature generator 50. The high set temperature generator 50 provides an output 51 which is applied to the high temperature detector 28 and to the vacuum set generator 49 in the vacuum control circuit 46. The vacuum control circuit 46 will automatically break the vacuum in the furnace at an adjustable point in temperature preceding the high set temperature level. A glaze override circuit 52 operates during short cycle selection to override the output 25 of the summing network 26.

Figure 3:
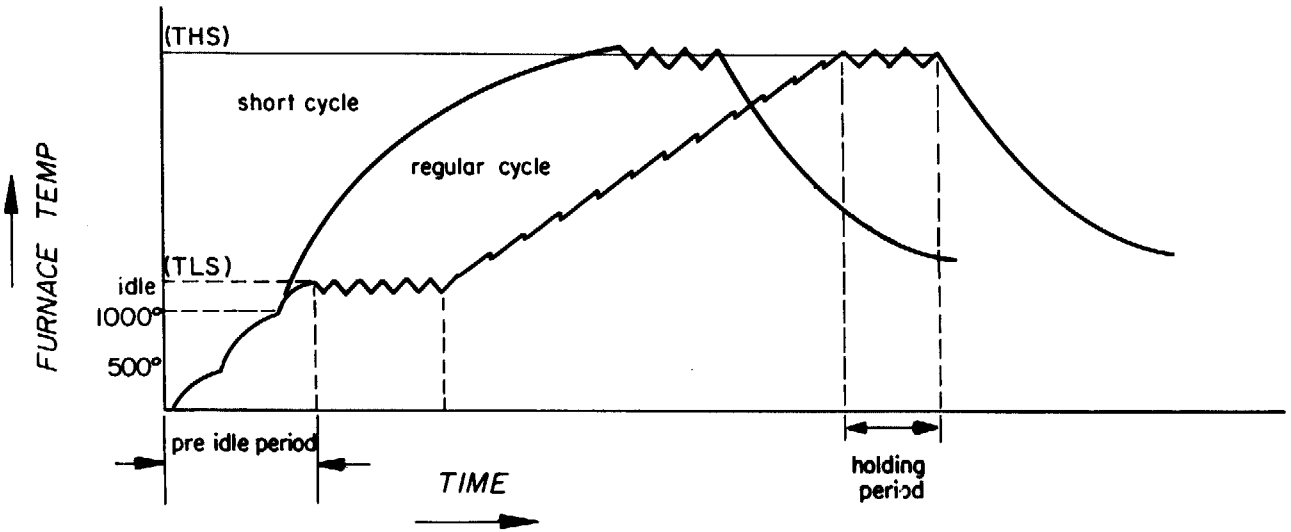
FIG. 3 is a time-temperature graph illustrating the furnace temperature time profile throughout the pre-idle, regular and glaze operating periods including the cool down period.

The temperature-time profile in the furnace chamber 12 for the regular curing cycle and the short glaze cycle is shown in FIG. 3. Until the low set idle temperatures TLS is reached, referred to as the pre-idle temperature period, the heater-drive control 22 responds to the heat staging circuit 23 to cause the temperature in the furnace chamber 12 to rise in incremental segments. The heat staging circuit 23 limits the average voltage supplied from the heater-drive control 22 to the heating elements (FIG. 4B) of the furnace chamber 12 is graduated incremental steps proportional to predetermined increases in furnace temperature. In the preferred embdiment the level of applied power is raised from 30 volts rms to 60 volts rms and then to 120 volts rms corresponding to staged increases in furnace temperature until the low set idle temperature TLS is reached. During the pre-idle temperature period the cycle control logic circuit 38 inhibits the ramp enable circuit 36 for disabling the ramp generator 32. The ramp generator 32 remains disabled until one of the cycles has been actuated, the low set idle temperature TLS reached and the platform 15 ascended to its top position.

In the regular curing cycle, the platform 15 is directed to begin its ascent to the top position as soon as the low set temperature TLS is reached. In the short glaze cycle, the cycle control logic 38 directs the glaze override circuit 41 to override the output 25 from the summing network 26 so as to cause the polarity detector 24 to continue to energize the heating drive control 22 until the furnace chamber 12 reaches the high set temperature level THS. In the regular curing cycle, the ramp generator 32 is enabled when the platform 15 has reached the top position as detected by the platform position detector 39. This causes the output 25 of the summing network 26 to decrease at a linear rate proportional to the decrease in ramp signal. When the output of the polarity detector 24 goes negative the heater-drive control 22 is energized for supplying power to the furnace chamber 12. Due to the hysteresis of the polarity detector 24 the instantaneous temperature in the furnace fluctuates about a linearly rising level proportional to the linear ramp signal output 31 of the ramp generator 32 until the output 33 is equal to the high set temperature output THS. The temperature fluctuation swings are of limited duration and magnitude and have no influence on the ceramic product 16.

When the temperature in the furnace chamber 12 equals the high set generator output, denoted THS, the high temperature detector 28 generates a strobe signal 27 which disables the polarity detector 24. The temperature in the furnace chamber 12 is maintained at the high set temperature level THS for a predetermined holding period followed by the cool down period in which the temperature in the furnace decays exponentially.

Figure 4A:
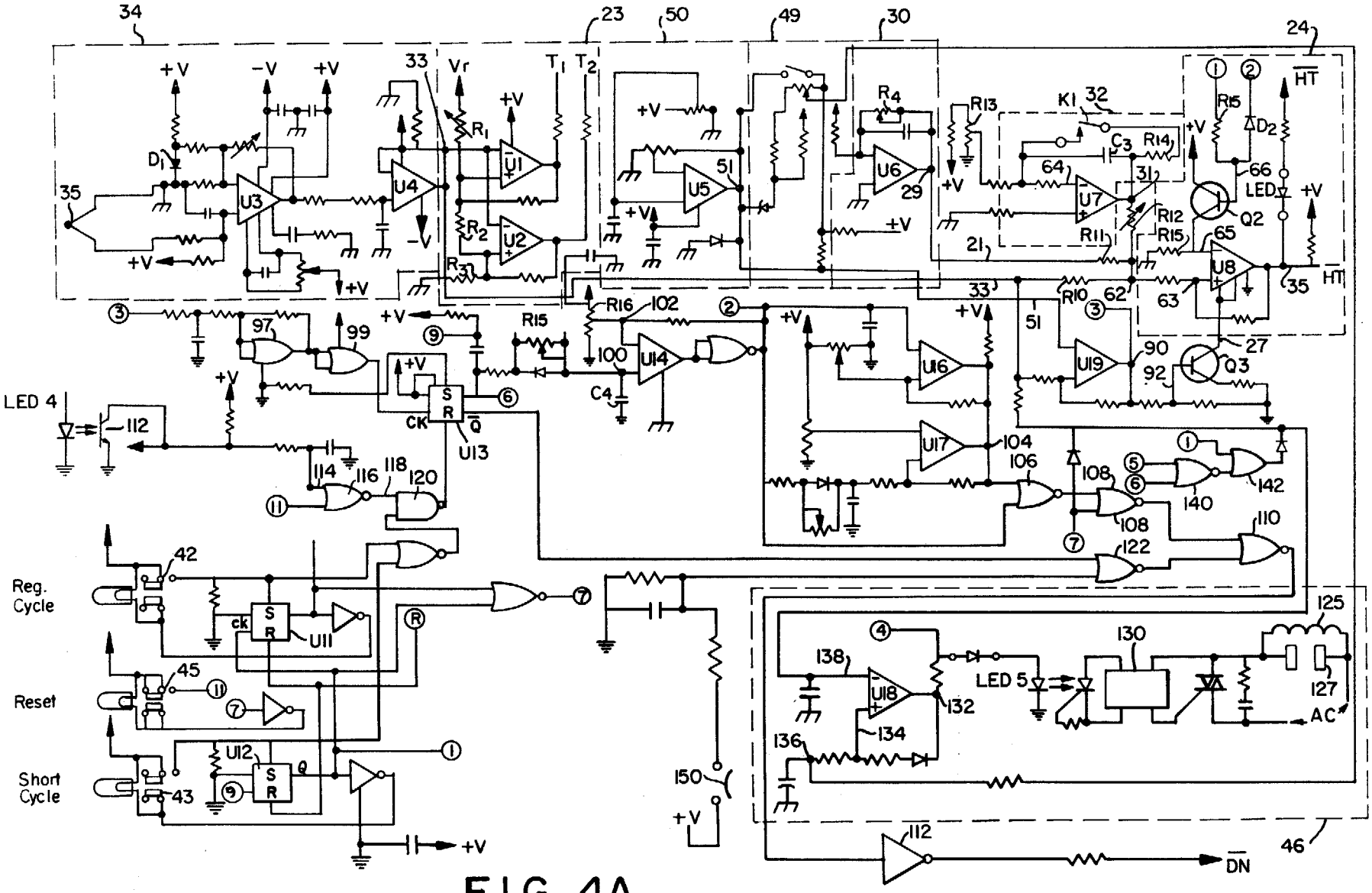
FIG. 4A is a detailed circuit schematic of the control system of FIG. 2 relating to the energizing and deenergizing of the heater control section.
Figure 4B:
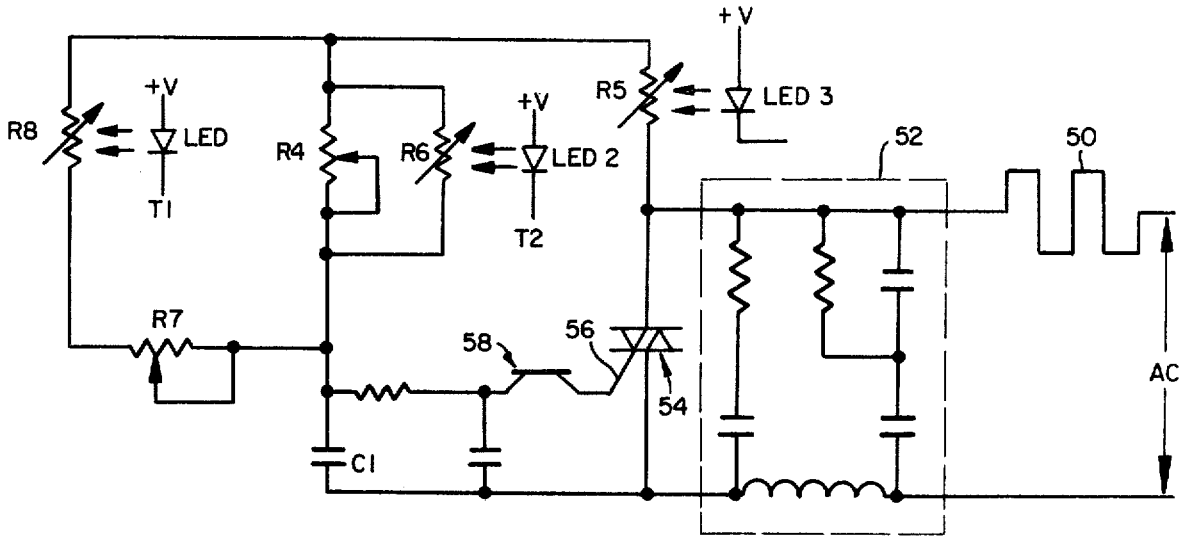
FIG. 4B is a detailed circuit schematic of the heater drive control of FIG. 2.
Figure 4C:
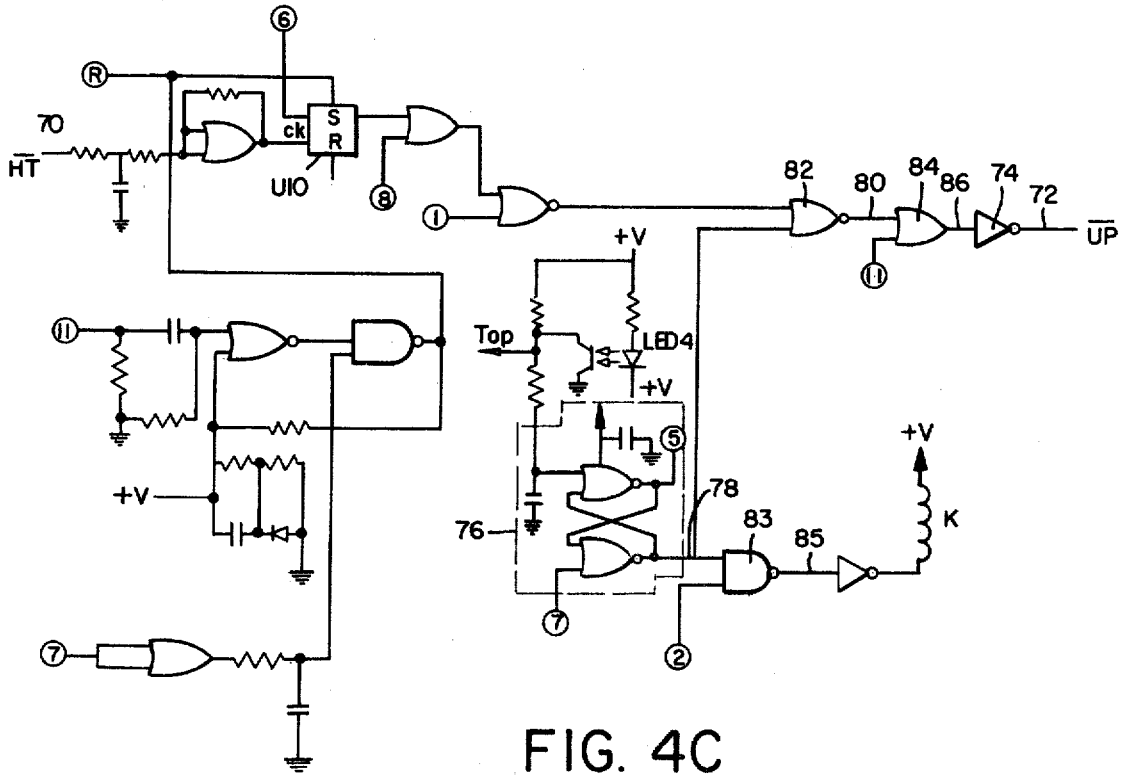
FIG. 4C is a circuit schematic of the idle temperature detection logic, ramp enable and reset logic of FIG. 2.

Referring now to the more detailed schematic diagrams of the control system of the present invention shown in FIGS. 4A, 4B and 4C respectively. The supply voltages are derived from a power supply circuit (not shown) which generate the supply voltages when the on/off function switch 41 of FIG. 2 is placed in an "on" position. The temperature sensor circuit 34 includes a thermocouple 35 with its heating junction positioned to be responsive to the temperature in the furnace chamber 12. The thermocouple 35 is cold junction compensated by diode D1 against thermal variations in the furnace housing. The thermocouple emf is amplified by amplifier U3 and applied through a buffer U4 to generate a thermal output sensor signal 33 proportional to the temperature of the furnace chamber. The output signal 33 is applied in common to the negative terminal of each cmparator U1 and U2 of the heat staging circuit 23.

The comparators U1 and U2 compare the output signal 33 from the temperature sensor circuit 34 to a proportional voltage derived from a fixed reference potential Vr. A voltage divider network composed of resistors R1, R2 and R3 determines the proportion of the reference voltage Vr applied to the positive terminal of each comparator U1 and U2 respectively. The outputs T1 and T2 from the comparators U1 and U2 are at a logical high signal level until the applied signal voltage 33 on their negative terminals equals the proportional voltage applied to their positive terminals. The output signals T1 and T2, are optically coupled to the heater-drive control circuit 22 (FIG. 4B) through light emitting diodes LED 1 and LED 2 respectively.

The heater drive control circuit 22 controls the application of power to the heating elements 50 in the furnace chamber 12. The heating elements 50 are coupled through a filter network 52 and a triac 54 to a conventional source of alternating voltage applied from the power supply circuit (not shown). The gate terminal 56 of triac 54 is connected through a diac 58 and an RC timing network formed by a capacitor C1 in combination with a network of resistors including a variable resistor R4 in series with a photo resistor R5. In parallel with variable resistor R4 is another photo resistor R6 and a series combination of variable resistor R7 and a third photo resistor R8. The photo resistors R6 and R8 are optically coupled to LED 1 and LED 2 of the heat staging circuit 23. The photo resistor R5 is optically coupled to an LED 3 connected in circuit with the output terminal of the polarity detector circuit 24.

The heat staging circuit 23 operates to control the heater-drive circuit 22 by varying the equivalent resistance in series with capacitor C1. During periods when LED 3 is deenergized the photo resistor R5 is theoretically of infinite resistance inhibiting the firing of the control gate 56 of the triac 54. When LED 3 is energized capacitor C1 is permitted to charge through adjustable resistor R4 to the break down voltage of diac 58. When diac 58 breaks down the control gate 56 of triac 54 is fired. The temperature in the furnace will rise until it reaches a first predetermined level of, for example, 500° F. At this temperature level the voltage 33 equals the voltage on the positive terminal of comparator U1 and the output signal T1 goes low energizing LED 1. This reduces the photo resistor R8 to essentially zero resistance which converts the resistance in series with capacitor C1 to an equivalent resistance composed of resistors R4 and R7 in parallel. The effect of this is to vary the firing angle of control gate 56 thereby increasing the average power supplied to the heating elements 50. When the temperature in the furnace reaches a second predetermined level of, for example, 1000° F. the LED 2 is energized which reduces photo resistor R6 to essentially zero resistance. This shorts out variable resistor R4. Accordingly, capacitor C1 is permitted to charge through almost zero resistance which advances the firing angle to essentially the zero cross-over in each cycle thereby providing maximum heating. Thereafter power is supplied to the heating elements 35 at the maximum constant average power level in response to the energization and deenergization of LED 3.

The summing network 26 (FIG. 4A) is composed of resistors R10, R11 and R12 respectively. The resistors R10, R11 and R12 are connected in common at the summing junction 62 which is applied to positive terminal 63 of the difference amplifier U8. The output sensor signal 33 of the temperature sensor 34 is applied as an input to resistor R10 whereas the output 29 of the low set generator 30 is applied to resistor R11 and the output 31 of the ramp generator 32 is applied to variable resistor R12. The low set generator 30 includes an operational amplifier U6 with its positive terminal connected to ground. The output 29 corresponds to the low set temperature TLS and is adjustable by varying adjustable R4. The ramp generator 32 includes a high gain operational amplifier U7 arranged in a conventional manner as a current integrator for integrating a constant current signal applied to its negative terminal 64. The output 31 is a negative voltage inversely proportional to the capacitance C3 which decreases linearly with a preset slope which may be varied by adjustment of variable resistor R13. A normally open contact K1 is connected across the combination of resistor R14 and capacitor C3. When contact K1 closes operation of the ramp generator 32 is inhibited. The contact K1 is a relay contact of the relay K in the ramp enable circuit 36 (FIG. 4C) the operation of which will be discussed hereafter.

The difference amplifier U8 of the polarity detector 24 has its positive terminal 63 connected to the output of summing network 26 and its negative terminal 65 connected through resistor R15 to ground potential. The negative terminal 65 is also connected through transistor Q2 to a positive overriding voltage V of, for example, 15 volts. In the regular operating cycle transitor Q2 is disabled by application of a logical low at pin 1 which is connected to the base terminal 66 through resistor R15. For purposes of clarity the inter-connecting points in the circuits are indentified by encircled pin numbers 1–9. The base 66 is also connected to pin 8 through diode D2.

The summing network 26 provides an input signal representing the algebraic addition of the low set voltage input 29 from the low set generator 30; the furnace temperature signal 33 from the temperature sensor 34; and the ramp output 31. The ramp output 31 is inhibited until the relay K in the ramp enable circuit 36 is deenergized.

In a regular cycle the platform 15 begins its ascent to the top position upon detection of the low set (idle) temperature TLS. A regular cycle is initiated by depressing switch 42 which sets D flip-flop U11. The low set idle temperature is detected when the D flip-flop U10 (FIG. 4C) is clocked in response to the application of a logical high signal at its input 70. The input 70 is connected to the output $\overline{HT}$ of the polarity detector 24. The output $\overline{HT}$ is negative or low until the temperature sensor signal 33 equals the low set input 29. At such time the output $\overline{HT}$ goes high which applies a clock pulse to the D flip-flop U10 which in turn causes an up signal "$\overline{UP}$" to be generated at the output 72 of the inverter 74. The up signal "UP" directs the up motor M1 to raise the platform 15. When the platform 15 reaches its top position the light emitting diode detector switch LED 4 (FIG. 4C) is energized which applies a logical low to the set-reset latch 76 causing the output terminal 78 to switch from a logical low to a logical high. This causes the output 80 of NOR gate 82 to switch to a logical low which in turn causes the output 86 of OR gate 84 to go low which is inverted through inverter 74 to remove the "up" signal. The output 78 is also applied to nand gate 83 causing the output 85 to go low which is inverted through inverter 88 to deenergize relay K. With relay K deenergized contact K1 returns to its normally open position enabling ramp generator 32. The ramp generator 32 as explained earlier generates a linearly decreasing output signal 31 with an adjustable negative slope controlled by variable resistor R12.

Once the ramp generator 32 is enabled the output 35 of polarity detector 24 rises until the high set temperature voltage level THS is reached following the curve illustrated in FIG. 3.

In the short glaze cycle transistor Q2 is energized by application of a logical low on its base terminal 66. The logical low at pin 1 is generated by depressing switch 42 which sets D flip-flop U12. Once transistor Q2 is energized a positive voltage is impressed on the negative input terminal 65 of difference amplifier U8 to maintain a logical low output 35 until the high set temperatures THS is reached.

The strobe input 27 to the difference amplifier 24 disables the polarity detector 24 to deenergize LED 3 independent of the algebraic output from summing network 26. The strobe input 27 is applied when the furnace temperature signal 33 reaches the high set output THS of the high set generator 48 or when manual reset is applied. The high temperature detector 28 includes a difference amplifier U19 with its output 90 connected to the base 92 of transistor Q3. When the output 90 of difference amplifier U19 goes high the transistor Q3 is turned on drawing current through the strobe terminal 27. The output of the difference amplifier U12 goes high whenever the furnace temperature signal 33 reaches the high set output THS and reverts back to low whenever the signal 33 drops below the high set output THS. Accordingly, the output 35 of the polarity detector 24 is switched back and forth by the strobe input upon reaching the high set temperature level THS. This continues for a predetermined holding or dwell period which generates a dwell signal at pin 2 upon its termination. The dwell signal 2 initiates the cool down operation and the descent of the platform 15. The dwell period may be varied by adjusting potentiometer R16.

The predetermined holding period begins when the furnace temperature signal 33 reaches the high set temperature level THS. The latter condition is indicated when the output 90 or pin 3 of the high temperature detector 28 goes high. This high signal is applied to a Schmitt Trigger composed of gate 97 which clocks up D flip-flop U13 applying a logical high to a charging circuit composed of a capacitor C4 and resistor R15. When terminal 100 is charged to a predetermined voltage equal to the potential on terminal 102 of amplifier U14 the dwell signal at pin 2 goes low. This dwell signal is applied to two interconnected timers composed of two adjustable time gate circuits comprising the difference amplifiers U16 and U17 respectively. The outputs are tied in common at terminal 104 representing one input to nor gate 106. The dwell signal at pin 2 is connected to the other input of nor gate 106. The output from the nor gate 106 is applied through several additional nor gates 108 and 110 and through the inverter 112 to provide the down signal $\overline{DN}$ which energizes motor M2 to bring the platform 15 down. The time gating from difference amplifiers U16 and U17 generates the down signal $\overline{DN}$ for a first (fixed) time period which is then timed out. This lowers the platform a first predetermined distance to provide a controlled quench for a predetermined time period. The down signal $\overline{DN}$ will then go to a high level, stopping platform descent until the second (adjustable) time period is over. The platform will then descend until the light emitting diode LED 4 in the platform position detector 39 is activated. This energizes photo transistor 112 impressing a low on input terminal 114 of nor gate 116. The output terminal 118 of nor gate 116 is applied to nand gate 120 which resets latch U13. This puts a low on the $\overline{Q}$ output which is applied to nor gate 122 for removing the applied down signal DN which stops platform 15. Reset can also be manually established at any point during any cycle by depressing the manual reset function switch 44. The manual reset applies a reset signal which is applied to the reset terminal of each flip-flop, e.g., U9 and U11 associated with each function switch respectively.

The furnace vacuum is established by depressing the vacuum function switch which causes the firing of a vacuum solenoid 125 and a vacuum pump 127 as is well known in the art. The vacuum solenoid 125 is energized through a source operating through a triac 129. A cnventional bridge rectifier 130 coupled to a photo-SCR fires the triac 129. The bridge rectifier 130 is optically coupled through LED 5 and the photo-SCR to the output 132 of the vacuum comparator U18. When the output is high vacuum is on. The comparator U18 compares a vacuum set voltage on input positive terminal 134 which is developed at terminal 136 from the potentiometer R18. This potential is derived from the high set output 51. The negative terminal 138 is connected to the furnace temperature output signal 33. In the regular cycle the output at 132 goes low when the furnace temperature equals a predetermined voltage below that of the high set temperature. This operates to break the vacuum.

A three input OR gate formed by the OR gates 140 and 142 will inhibit the initiation of a vacuum condition at any of the following times: when the platform 15 is not in the top position, when the temperature in the furnace reaches the high set level and when the short glaze cycle is on. A vacuum sensitive switch 150 is used to prevent the initiation of the down signal DN at any time while a vacuum still exists in the chamber.

What is claimed is:

1. A control system for operating a radiant furnace having a furnace chamber, heating elements for applying radiant energy to said chamber and movable platform means for supporting porcelain ceramic material to be cured at a controlled temperature level within said chamber; said control system comprising:

first presettable means for generating a low temperature control signal representative of a preselected low temperature setting;

second presettable means for generating a high temperature control signal representative of a preselected high temperature setting;

means for generating a sensor signal responsive to the furnace temperature in said chamber;

ramp signal generating means for generating a linearly varying ramp output singal of predetermined slope;

means responsive to said low temperature control signal and to the furnace temperature in said chamber for disabling said ramp signal generating means until the furnace temperature in said chamber is equal to said preselected low temperature setting;

summing means for algebraically summing said low temperature control signal, said ramp output signal and said sensor signal to produce an error signal;

polarity detector means responsive to said error signal for generating a heat control signal having a first logical level when said error signal is of a first polarity and having a second logical level when said error signal is of a second polarity opposite said first polarity;

power supply circuit means responsive to said heat control signal for applying electrical energy to said heating elements when said heat control signal is at said first logical level; and means responsive to said high temperature control signal and said sensor signal for applying a strobe signal to said polarity detector means when said sensor signal reaches said high temperature setting so as to cause the logical level of said heat control signal to revert to said second logical level independent of said error signal.

2. A control system as defined in claim 1 further comprising heat staging temperature circuit means responsive to said temperature sensor signal for phase controlling said power supply circuit means so as to vary the applied electrical energy to said heating elements in predetermined incremental levels of increasing magnitude until the preselected low temperature is reached.

3. A control system as defined in claim 2 wherein said power supply circuit means comprises a source of AC line voltage and switching means for impressing said source of AC line voltage across said heating elements.

4. A control system as defined in claim 2 wherein said heat staging temperature circuit means comprises:

capacitor means connected in circuit with said AC line voltage for enabling said switching means during each cycle of AC line voltage;

a first equivalent resistance circuit means;

a second equivalent resistance circuit means; and means responsive to said temperature sensor signal for switching said capacitor means in series circuit relationship with said first equivalent resistance circuit means when said temperature sensor signal reaches a first predetermined magnitude and for switching said capacitor in series circuit relationship with said second resistive circuit means when said temperature sensor signal reaches a second predetermined magnitude.

5. A control system as defined in claim 2 further comprising detector means responsive to the position of said platform for providing an up position output signal when said platform has ascended into sealed engagement with said furnace and means responsive to said detector means for disabling said ramp signal generating means until said up position output signal is generated.

6. A control system as defined in claim 5 further comprising manual preset vacuum control means for establishing a vacuum in said furnace in response to said detector means and including means responsive to said temperature sensor signal for breaking said vacuum at a predetermined temperature below said preselected high temperature setting.

7. A control system as defined in claim 2 further comprising manual preset short cycle operating means responsive to the temperature in said furnace for applying a signal to said polarity detector means overriding the error signal output of said summing means for generating said first logical level when the temperature in said furnace equals the preselected low temperature signal level.

8. A control system as defined in claim 7 further comprising time delay means responsive to said high temperature control signal for generating a time delay signal; means responsive to said time delay signal and to the temperature in the furnace for applying a control signal to said polarity detector means such that the furnace temperature is maintained at the preselected high temperature setting for a predetermined dwell period represented by the duration of said time delay signal.

* * * * *